US011248417B2

(12) United States Patent
Brinkman et al.

(10) Patent No.: US 11,248,417 B2
(45) Date of Patent: Feb. 15, 2022

(54) VERTICALLY FOLDING BARRIER GATE ARM HAVING A MULTI-ARTICULATED COMPOUND HINGE

(71) Applicants: Jonathan Brinkman, Key Largo, FL (US); Randy Perez, Key Largo, FL (US)

(72) Inventors: Jonathan Brinkman, Key Largo, FL (US); Randy Perez, Key Largo, FL (US)

( * ) Notice: Subject to any disclaimer, the term of this patent is extended or adjusted under 35 U.S.C. 154(b) by 77 days.

(21) Appl. No.: 16/819,089

(22) Filed: Mar. 14, 2020

(65) Prior Publication Data

US 2020/0291721 A1 Sep. 17, 2020

Related U.S. Application Data

(60) Provisional application No. 62/818,615, filed on Mar. 14, 2019.

(51) Int. Cl.
*E01F 13/00* (2006.01)
*E06B 11/02* (2006.01)

(52) U.S. Cl.
CPC ..... *E06B 11/022* (2013.01)

(58) Field of Classification Search
CPC ..... E06B 11/022; E06B 11/025; E01F 13/06
USPC ..... 49/49
See application file for complete search history.

(56) References Cited

U.S. PATENT DOCUMENTS 437,727 A * 10/1890 Smith ..... E01F 13/06 49/124
526,941 A * 10/1894 Phillippi ..... E01F 13/06 49/124
533,481 A * 2/1895 Mershon ..... E01F 13/06 49/124
1,545,231 A * 7/1925 Buttrick ..... B61L 29/20 49/124
3,925,930 A * 12/1975 Gail ..... E01F 13/06 49/124
6,189,839 B1 * 2/2001 Lemieux ..... E01F 13/048 246/127

(Continued)

FOREIGN PATENT DOCUMENTS

CA 2312524 A1 * 12/2000 ..... B61L 29/04
DE 202013010383 U1 * 1/2014 ..... E01F 13/06

(Continued)

*Primary Examiner* — Jerry E Redman
(74) *Attorney, Agent, or Firm* — Allen F. Bennett; Bennett Intellectual Property

(57) ABSTRACT

A vertically folding barrier gate arm has a proximal first segment and a distal second segment connected by a pivot hinge allowing them to fold. An extension set pivotally affixed to an outer offset bracket on the housing for the motor of the gate arm is connected to an outer offset bracket on the distal gate arm segment by a multi-articulated compound hinge formed by a plurality of links attached to each other by hinges providing a constrained range of rotation relative to each other. The gate arm translates from a fully extended position where the proximal and distal gate arm segments are parallel and co-linear along a horizontal longitudinal axis, to a vertically folded position where the proximal and distal gate arm segments lie substantially against each other within the plane of rotation of the first segment.

12 Claims, 14 Drawing Sheets

(56) References Cited

U.S. PATENT DOCUMENTS

| | | | | |
|---|---|---|---|---|
| 2005/0060936 | A1* | 3/2005 | Burke | B61L 29/04 49/49 |
| 2020/0291721 | A1* | 9/2020 | Brinkman | E06B 11/025 |
| 2021/0123197 | A1* | 4/2021 | Matthews | E01F 13/12 |

FOREIGN PATENT DOCUMENTS

| | | | | |
|---|---|---|---|---|
| FR | 2681887 | A1 * | 4/1993 | E01F 13/06 |
| JP | 05239981 | A * | 9/1993 | |

* cited by examiner

VERTICALLY FOLDING BARRIER GATE ARM HAVING A MULTI-ARTICULATED COMPOUND HINGE

CROSS-REFERENCE TO RELATED APPLICATIONS

This application claims priority to U.S. Provisional Application Ser. No. 62/818,615 filed on Mar. 14, 2019, the contents of which are hereby incorporated by reference.

STATEMENT REGARDING FEDERALLY SPONSORED RESEARCH OR DEVELOPMENT

Not Applicable.

NAMES OF PARTIES TO A JOINT RESEARCH AGREEMENT

Not Applicable

REFERENCE TO SEQUENCE LISTING, A TABLE, OR A COMPUTER PROGRAM LISTING APPENDIX SUBMITTED ON A COMPACT DISC AND INCORPORATION-BY-REFERENCE OF THE MATERIAL

Not Applicable.

COPYRIGHT NOTICE

Not Applicable

BACKGROUND OF THE INVENTION

Field of the Invention

The present invention relates to a vertically folding barrier gate arm. More particularly, the invention relates to vertically folding barrier gate arm having a multi-articulated compound hinge for controlling vehicular access over a roadway, typically where area above the gate arm is limited.

Description of the Related Art

Barrier gate arms are frequently used for parking lots, parking decks, turnpikes and other locations where vehicle access needs to be controlled. In many of these locations, a ceiling above the barrier arm limits the clearance available for vertically rotating the gate arm. One option is to use a horizontally rotating barrier gate arm. However, in confined spaces such as a parking garage, there may also be insufficient space to accommodate rotating the barrier gate arm 90° horizontally.

Another option is to install a folding barrier gate arm. Typically, a folding barrier gate arm has a proximal, first segment which rotates vertically 90°, and a second, distal or outer second segment which remains horizontal, folding in a direction opposite to the direction of rotation of the first segment by approximately 90°. The result is barrier arm with two sections that are fully extended across the lane when a closed position, blocking a vehicle or other object from passing. The gate arm translates to an L-shaped open configuration to allow vehicles other objects to pass. While these 90° folding barrier gate arms are fairly simple to install and generally effective, the outer distal second segment extends over the roadway or passage, further reducing the clearance for a vehicle. In addition to limiting the height of a passing vehicle, the outer second segment is susceptible to accidentally being hit by tall vehicles.

Yet another option is to install a vertically folding barrier gate having a second distal outer segment which folds 180° in a direction opposite to the direction of the first proximal segments 90° rotation. These fully folding vertical barrier gate arms provide vehicles with the maximum vertical clearance when open. One drawback of these vertically folding barrier gate arms is that the outer distal second segment tends to "wobble" or bang against the first segment in high wind or as a result of a relatively loose connection to the proximal first segment. To minimize this, vertically folding barrier gate arms are usually designed to apply rotational force, i.e. torque, to the second segment when the barrier gate arm is in the open position to secure the second segment substantially flush to the first segment. However, this design is not very effective at preventing the second segment from wobbling. Can lead to entrapment of objects between the two segments as the barrier gate arm translates into the folded configuration. Additionally, a person could get hurt or an object damaged when the barrier gate arm closes or comes down on them as the full force of the operator motor's power works across the entire length of the arm.

Another drawback of these vertically folding barrier gate arms is that the entire barrier gate arm is an intimate part of the system that controls its articulation. For example, the extension set or other mechanism used to rotate the outer second segment of the arm is attached to the pivot hinge connecting the two segments and/or the first segment. As a result, if any part of the barrier gets damaged, the arm segments and articulating parts need to be replaced as one unit, making repairs unnecessarily expensive. These designs are also designed around the use of a flat barrier arm, so cylindrical gate arms are generally not compatible with this technology. In addition, vertically folding barrier gate arms generally only come in a few discrete sizes, which often are either too long or too short for a particular application. There is no simple straightforward way to modify the lengths of these barrier gate arms to adequately accommodate ceilings of varying heights.

The above-described deficiencies of today's systems are merely intended to provide an overview of some of the problems of conventional systems, and are not intended to be exhaustive. Other problems with the state of the art and corresponding benefits of some of the various non-limiting embodiments may become further apparent upon review of the following detailed description.

In view of the foregoing, it is desirable to provide a vertically folding barrier gate arm that minimizes damage to objects caught between the segments of the folding gate arm as it translates to the open position. It is also desirable to provide vertically folding cylindrical barrier gate arms. It is also desirable to provide vertically folding barrier gate arms having increased stability.

BRIEF SUMMARY OF THE INVENTION

Disclosed is a folding multi-articulated barrier gate arm comprising a proximal first segment, an outer, distal second segment, an offset plate fixedly installed on the barrier gate arm motor housing, a extension set pivotally attached to the offset plate, and a multi-articulated compound hinge connecting the extension set to the second segment of the arm. The first and second segment are joined by a 180° pivoting hinge which allows them to rotate relative to each other and translate between a folded configuration where the first and second segments within the plane of rotation of the proximal first segment and the pivoting hinge is rotated 0°, and an extended configuration where the first and second segments are co-linear, each segment extending in opposite directions from the pivoting hinge, and the pivoting hinge is rotated 180°.

The multi-articulated compound hinge is formed by a plurality of links which are interconnected by hinges constrained to a limited range of rotation. The sum total of all the rotations of all of the individual hinges connecting the links allow the multi-articulated compound hinge to rotate from 0° to 180°. When the barrier gate arm is in the horizontal, closed position, all the links are pulled by the extension set into a straight, co-linear configuration, so that the compound hinge rotates to 180°, forcing the pivoting hinge to rotate 180° into the extended position such that the outer, distal second segment extends distally away from the first segment. When the proximal first segment of the barrier gate arm is rotated into a vertical position, the tension on the multi-articulated compound hinge is relaxed, allowing gravity to provide the force to rotate the multi-articulated hinge and fold the second segment in the plane of rotation of the first segment.

It is therefore an object of the present invention to provide a vertically folding barrier gate arm that minimizes the total space required for operation and optimally utilizing the clearance above a roadway blocked by the barrier gate arm. It is also an object of the invention to prevent entrapment of objects between the two segments of the gate arm. It is another object of the invention to provide a vertically folding barrier gate arm stabilized to prevent the outer segment from wobbling relative to the proximal segment of the gate arm. It is also an object of the invention to provide a vertically folding gate arm that is field serviceable, end-user customizable, and easy to install. These and other objects and advantages of the present invention will become apparent from a reading of the attached specification and appended claims.

There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Figure 1:
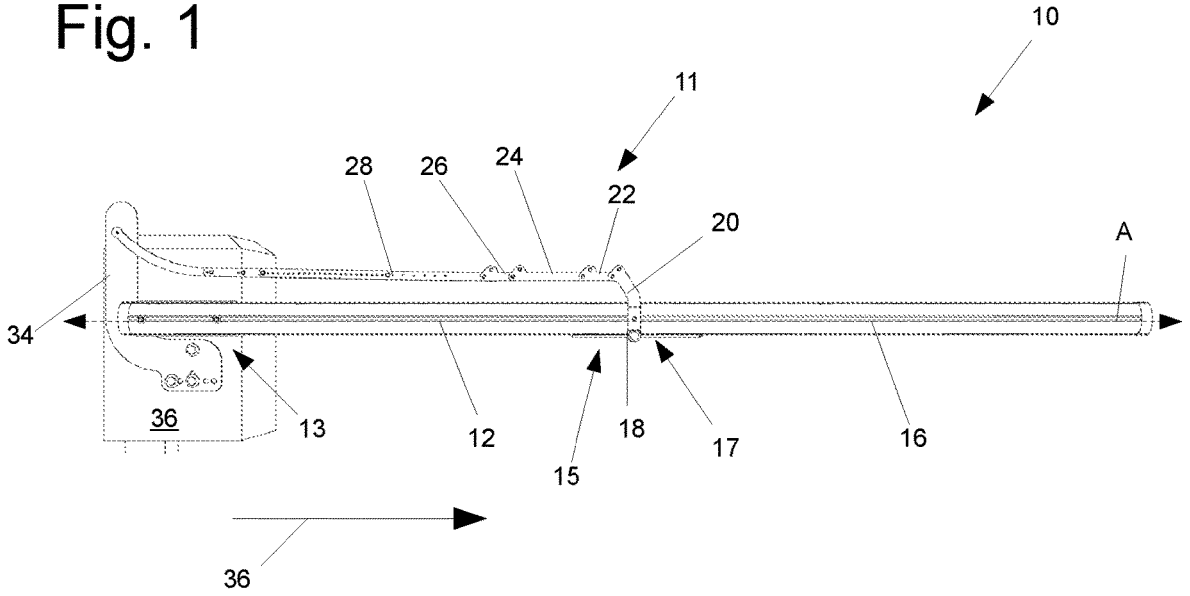
FIG. 1 is a front view of a vertically folding barrier gate arm in a fully extended closed position in accordance with principles of the invention.
Figure 2:
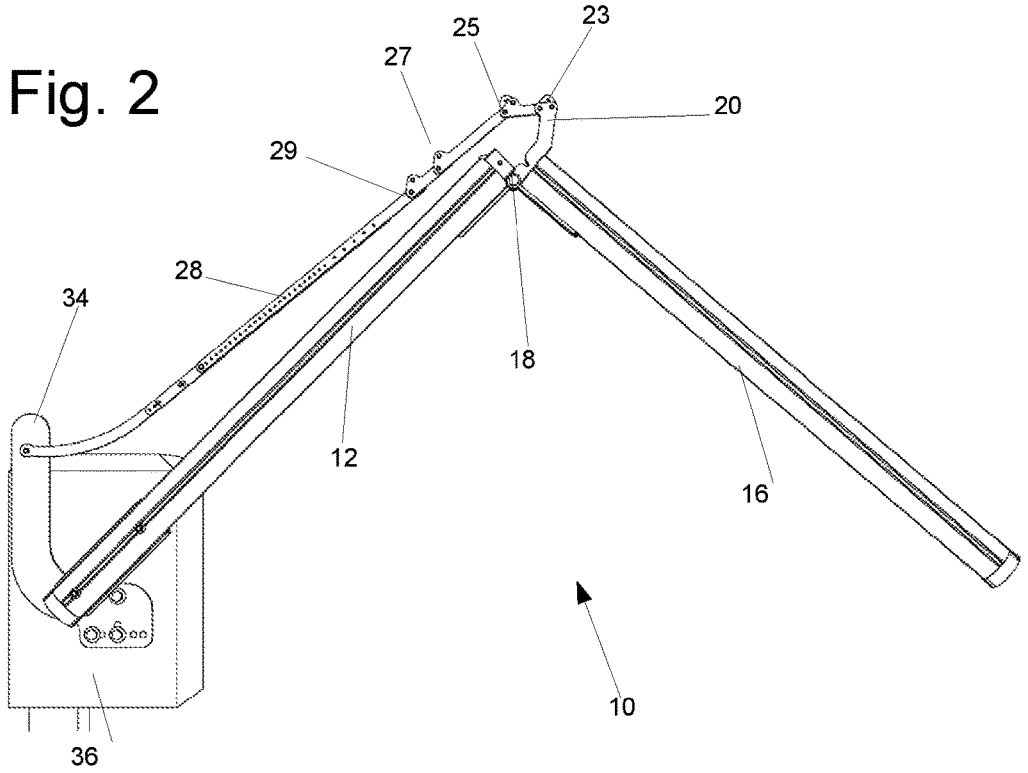
FIG. 2 is a front view of a vertically folding barrier gate arm in an intermediary position in accordance with principles of the invention.
Figure 3:
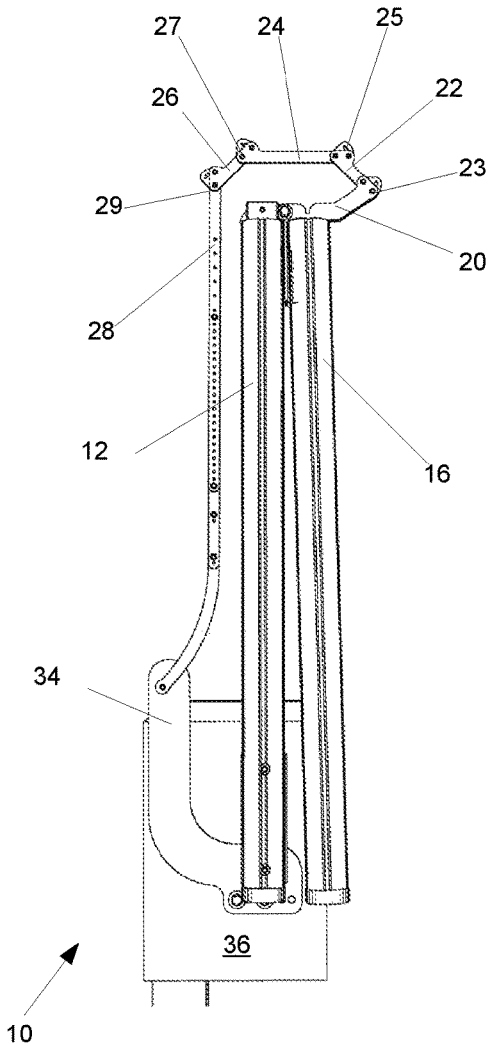
FIG. 3 is a front view of a vertically folding barrier gate arm in a fully folded open position in accordance with principles of the invention.
Figure 4:
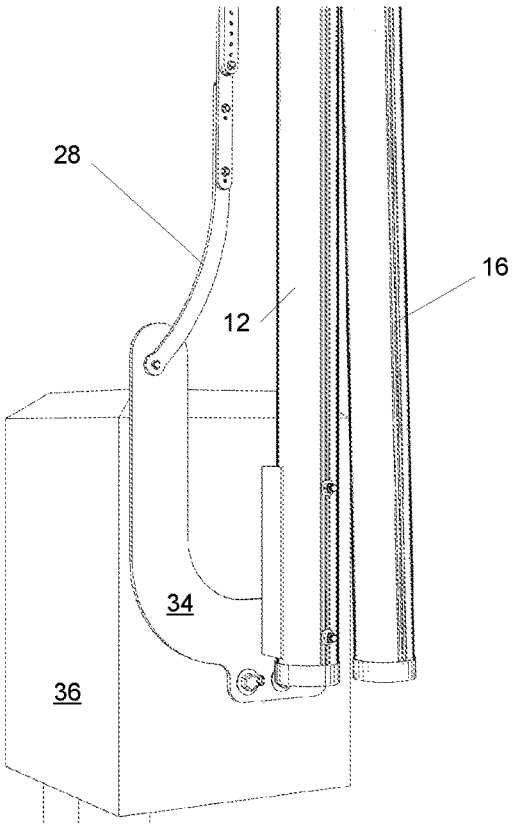
FIG. 4 is an enlarged view of an offset plate of a vertically folding barrier gate arm in accordance with the principles of the invention.
Figure 5:
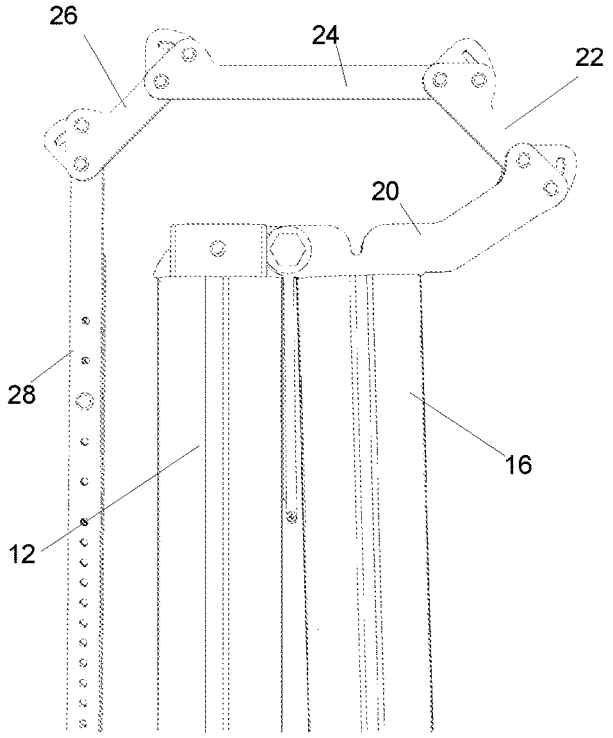
FIG. 5 is a front view of the links of a vertically folding barrier gate arm in accordance with principles of the invention.
Figure 6:
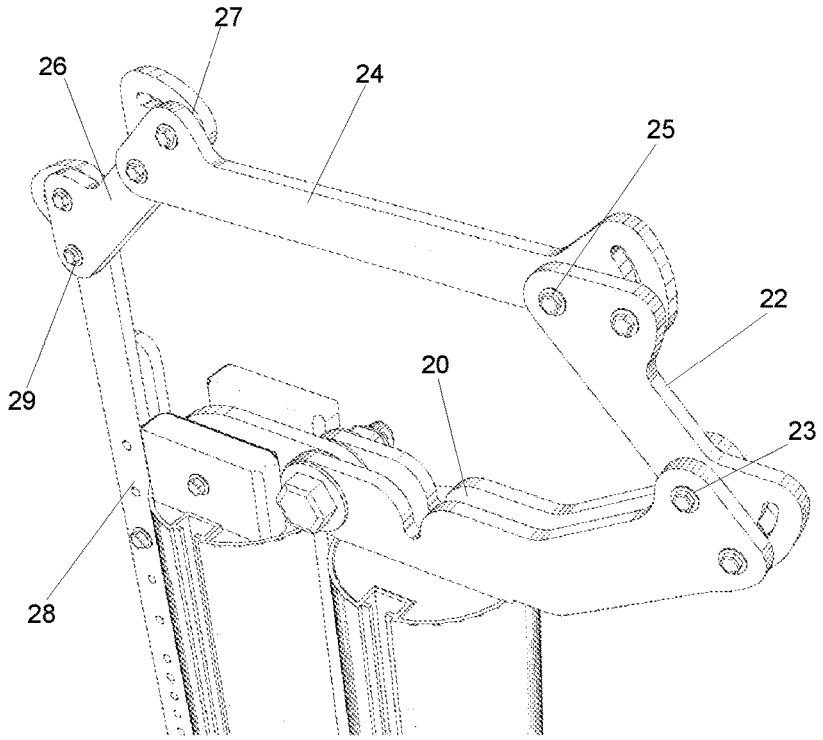
FIG. 6 is a perspective view of the links of a vertically folding barrier gate arm in accordance with the principles of the invention.
Figure 7:
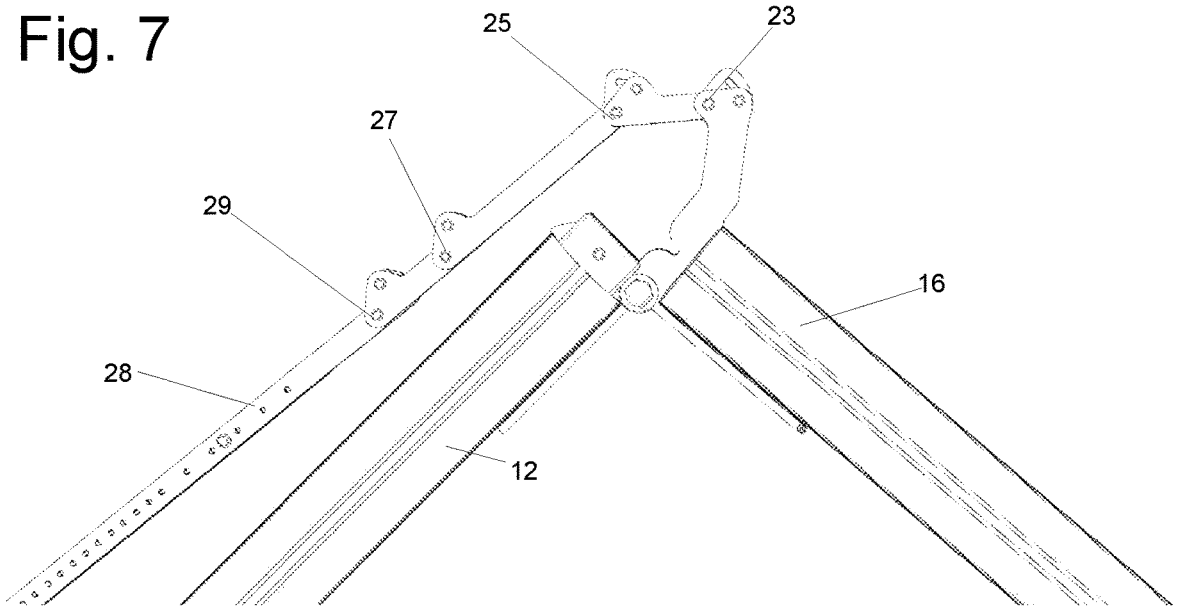
FIG. 7 is a front view of the links of a vertically folding barrier gate arm in accordance with the principles of the invention.

The disclosed subject matter is described with reference to the drawings, wherein like reference numerals are used to refer to like elements throughout. In the following description, for purposes of explanation, numerous specific details are set forth in order to provide a thorough understanding of the various embodiments of the subject disclosure. It may be evident, however, that the disclosed subject matter may be practiced without these specific details. In other instances, well-known structures and devices are shown in block diagram form in order to facilitate describing the various embodiments herein.

The invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. However, it should be noted that no definition should be regarded as being superceding any art-accepted understanding of the terms used herein, unless explicitly described otherwise.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form. "Horizontal" should generally be construed to mean parallel to the ground. "Vertical" should generally be construed to mean perpendicular to the ground. Elements which are described as "co-linear" should generally be construed as elements which lie along or are centered around the same substantially straight line.

Various embodiments of the disclosure could also include permutations of the various elements recited in the claims as if each dependent claim was a multiple dependent claim incorporating the limitations of each of the preceding dependent claims as well as the independent claims. Unless explicitly stated otherwise, such permutations are expressly within the scope of this disclosure.

Disclosed is a vertically folding gate arm having a compound hinge in accordance with the principles of the invention and embodying technology unlike what is on the existing market. FIGS. 1-10 show an exemplary embodiment of a vertically folding barrier gate arm having a compound hinge in accordance with the principles of the invention. FIG. 1 shows the vertically folding barrier gate arm 10 extending horizontally in a distal direction 11 away from the motor housing 36, defining a longitudinal axis A. A first segment 12 is rotatably attached to the gate arm's motor housing 36 at its proximal end 13 and is pivotally attached to a second segment 16 at its distal end 15 by a pivot hinge 18. An outer offset bracket 20 extends perpendicularly upward from the proximal end 17 of the second segment 16. The outer offset bracket 20 extends vertically upward from the vertically folding barrier gate arm 10 when it is extended longitudinally in the closed horizontal position shown in FIG. 1. The outer offset bracket 20 extends horizontally in a distal direction 11 when the vertically folding barrier gate arm 10 is in the folded position shown in FIG. 3.

In this embodiment, the folding barrier gate arm 10 of the invention includes a multi-articulated compound hinge 11 connecting the extension set 28 to outer offset bracket 20. The compound hinge 11 is formed by a plurality of links interconnected by hinges between the links. In the embodiment shown in FIG. 1, the multi-articulated compound hinge 11 is formed from a first link 22, second link 24 and third link 26. Each link's range of rotation is constrained by the hinges at its ends. For example, the links may be constrained to rotating only from 0° to 45° relative to each other or the other components to which they are connected. When the barrier is in the fully extended, closed horizontal position, the operator motor is parked so that the proximal barrier gate arm segment 12 becomes parallel with the street and perpendicular to the operator enclosure. The proximal gate arm segment 12 and distal outer barrier gate arm segment 16 are made co-linear by the outer barrier arm's outer offset bracket 20 being pulled toward the stationary offset plate 34 as the first segment is rotated from the open upright vertical position to the closed horizontal position. Conversely, as the first segment 12 is rotated from a closed horizontal position, shown in FIG. 1, to an upright, vertical position, shown in FIG. 3, the tension on the second segment 16 connected to the offset plate 34 is relaxed and gravity causes the second segment 16 to rotate downward to a position close to, but not touching, the first segment 12. As this happens, the links 22, 24 and 26 are free to rotate within their constrained angles, potentially at random, and relative to each other. As the first segment 12 is rotated upward, each segment will reach a point where it can no longer rotate because it has been constrained by the individual hinges of the compound hinge 11.

Figure 8:
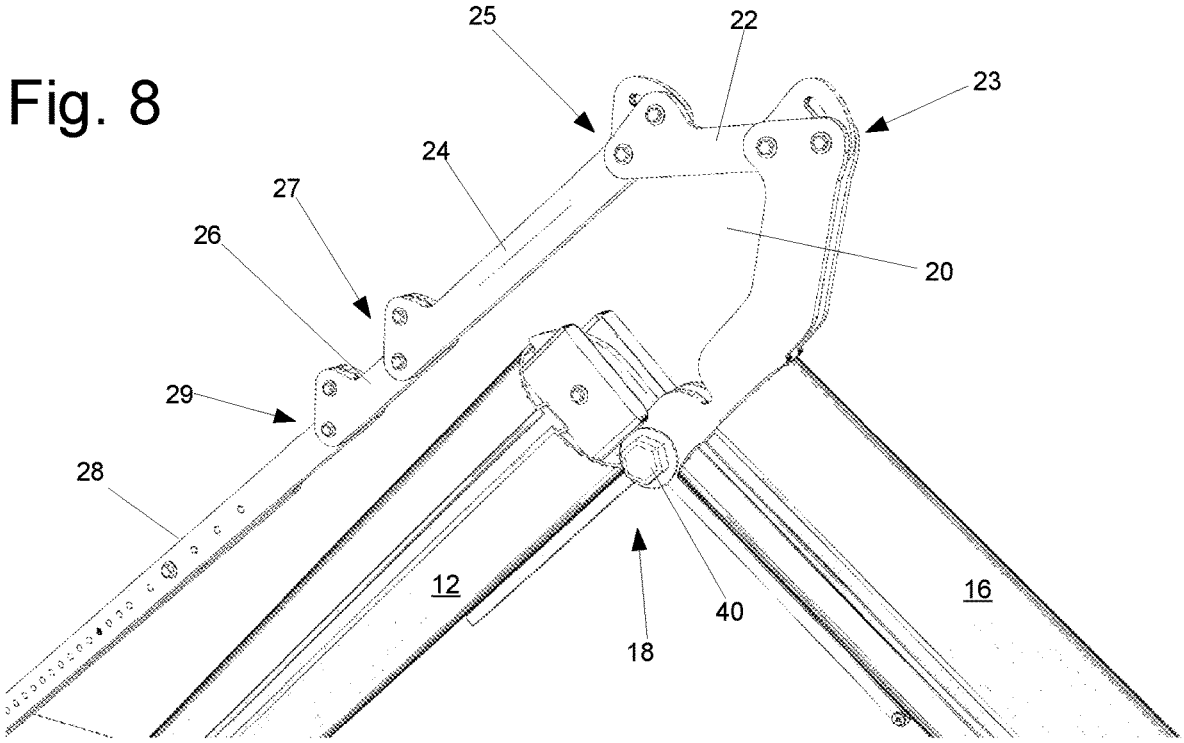
FIG. 8 is a perspective view of the links of a vertically folding barrier gate arm in accordance with principles of the invention.
Figure 9:
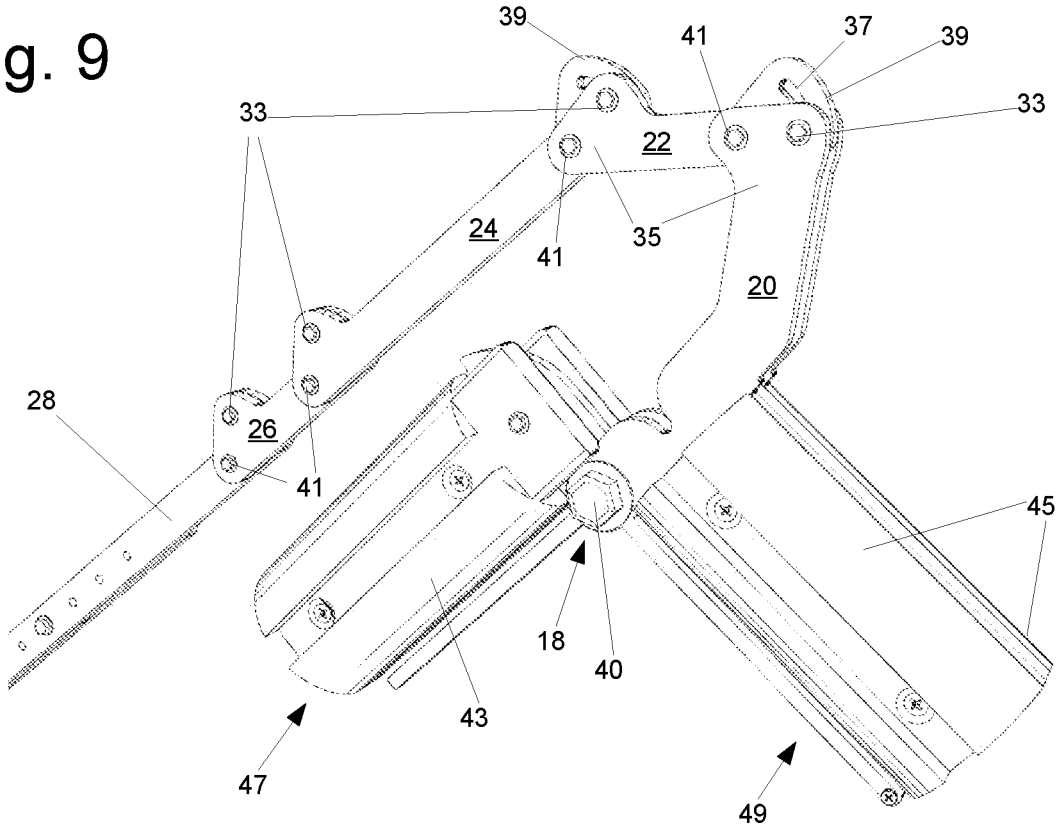
FIG. 9 is another perspective view of the links the vertically folding barrier gate arm in accordance with the principles of the invention.
Figure 10:
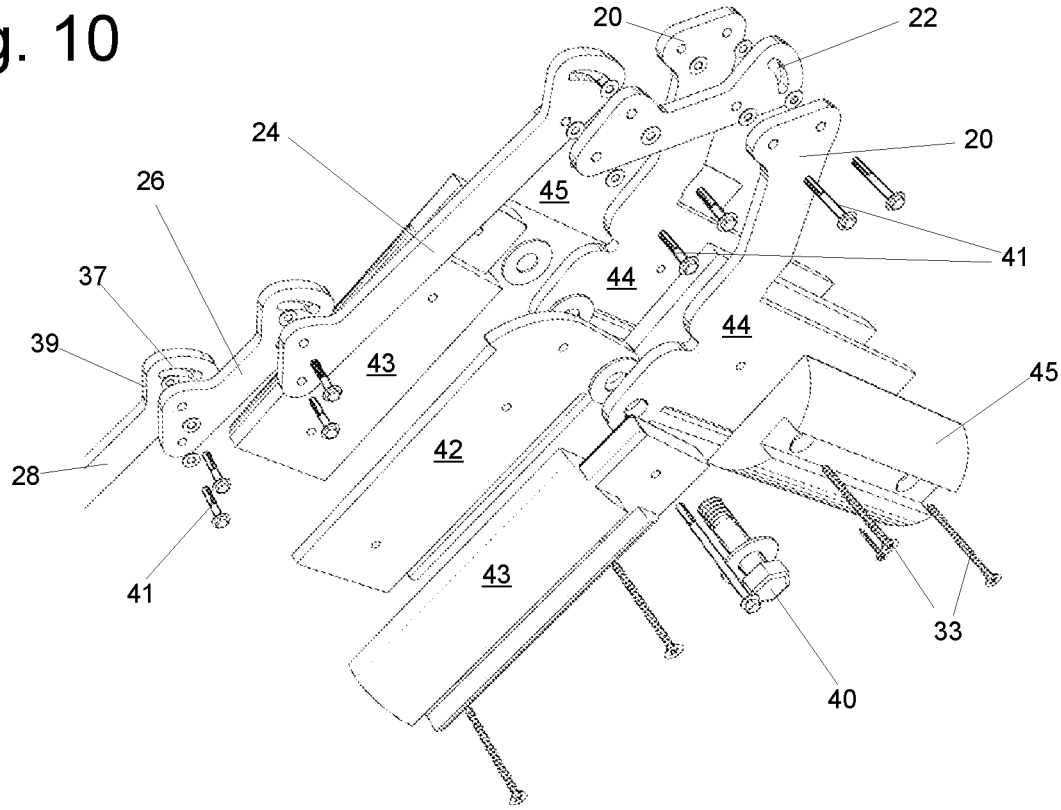
FIG. 10 is an exploded perspective view of the links of the vertically folding barrier gate arm in accordance with principles of the invention.

Referring to FIGS. 8-10, each of the first, second, third and fourth hinges 23, 25, 27 and 29, connecting the outer offset bracket 20, first links 22, second link 24, third link 26 and extension set 28, respectively, are constrained by a bolt 33 on the male plate 35 of the hinge that moves through a curved slot 37 on the female plate 39 of the hinge and rotate about a pivot pin 41. Each of the hinges forming the compound hinge 11 thus has a similar configuration, but may have different ranges of rotation depending on the length of the slots 37. Optionally, the bolts 33 and/or pivot pins 41 may be tightened sufficiently to prevent unintentional rotation, but not so tight as to impair mechanical articulation. The curved slot of each hinge 23, 25, 27 and 29 constraining the rotational range of the hinge and can be any size so long as the total sum of constraints provides up to 180° rotation of the outer arm. Some of the factors used for deciding on the number of links to use are 1) The use of fewer links creates more stress on the hinges; 2) The use of odd-numbered links create a triangular peak at the top of a folded arm that reduces the ceiling clearance, usually most pronounced with only three links; 3) Too many links can make it more difficult to shape the articulation radius so as to prevent the articulation hardware from bumping into the segments of the gate arm; 4) More links add production and maintenance costs. Without being bound by theory, the inventors believe that a compound hinge having four links is an optimal compromise of all the mentioned factors. The link assembly have a minimum and maximum total rotation which as mentioned should provide 180° movement.

De-Bounce Protection:

If the arm segments are permitted to close to a full 180°, the second segment 16 may impinge upon the first segment 12. Thus, it is preferable to limit the total maximum rotation angle below 180°, for example 170° to 175°. This causes the compound hinge to act as a brake which enforces a small clearance between the arm segments and prevents or reduces strain and damage to the gate arm segments when the gate arm is fully open.

Variability of Offset-Plate Mounting Position.

Various installation situations may require the drilling of the pivot bolt on the offset plate to be higher than the barrier arm, thus requiring some flexibility of the articulation mechanism in the horizontal position. It is generally recommended that the link closest to the offset plate have a slot that provides negative angles, which will accommodate imprecise pivot bolt positioning. Introducing this variability to other links can introduce noticeable sagging and potential additional mechanical stress.

Entrapment Protection:

Since the articulating movement of the multi-articulated compound hinge is partially dependent on gravity, an object caught between the first segment 12 and the second segment 16 will not be squeezed between the two arms. If a person or object gets caught between the scissor-like moving parts, the articulating mechanism will not apply any significant force to clamp the arms shut, so the obstruction can be cleared with little to no damage caused to it or the arm.

In this first embodiment, a first link 22 is pivotally affixed to the outer offset bracket 20 by hinge 23 and extends proximally at a 90° angle from the outer offset bracket when the vertically folding barrier gate arm 10 is in the fully extended position. The hinge 23 rotates into a configuration in which the first link 22 and outer offset bracket 20 form a 45° angle as the vertically folding barrier gate arm 10 is folded into the open position. The second link 24 is similarly constrained to rotating 45°, from 180° to 135°, relative to the first link 22 as the articulating gate arm 10 translates between an extended and folded position. A third link 26 is constrained to rotating 45° relative to the second link 24 as the articulating gate arm 10 translates between an extended and folded position. The third link 26 is also constrained to a 45° rotation relative to the extension set 28 which extends from the third link 26 to an offset plate 34 rigidly affixed to the motor housing 36. Those skilled in the art will appreciate that all of the links 22, 24 and 26 will begin folding to some extent at different times based upon exterior forces on the vertically folding barrier gate arm 10 during translation between the open and closed positions.

In use, the vertically folding barrier gate arm 10 begins in the fully extended position shown in FIG. 1. Upon actuation, the first segment 12 rotates clockwise from a horizontal configuration into a vertical configuration. As the first segment 12 rotates, gravity causes the distal gate arm 16 to rotate in an equal and opposite direction facilitated by the links 22, 24 and 26. The extension set 28 rotates parallel to the first segment 12 but slides relative thereto. The sliding of the extension set 28 parallel to the first segment 12 provides slack in the connections between the extension set 28 to the outer offset bracket 20. As a result, the first link 22 pivots relative to both the outer offset bracket 20 and the second link 24 until it has rotated to its maximum 45° counterclockwise relative to the outer offset bracket 20. At that point, the second link 24 pivots relative to the first link 22 until it also has reached its maximum 45° pivots. The third link 26 then begins to pivot to its maximum of 45° relative to both the second link 24 and the extension set 28. At that point, the gate arm 10 is in the fully folded open position with the first segment 12 and the second segment 16 folded such that they are aligned vertically and both within the plane of rotation. When the gate arm is in the fully extended position, all the links 22, 24 and 26 and the extension set 28 are aligned parallel in a straight line. It is important to note that the 45° angle constraints of this embodiment are not intended to be limiting. Each of hinges 23, 25, 27 and 29 may each provide different ranges of rotation, so long as the total rotation of the compound hinge 11 is between about 170° and 180°. For example, hinge 23 could provide 60° while hinge 27 provides 30° or rotation. If fewer than three links are used to form the compound hinge 11, larger angles may be used. If more than three links are used, the some or all of the hinges may limit rotation to less than 45°.

The extension set 28 is preferably rigid but may optionally be flexible. For example, a cable can be used as flexible extension set 28. Because the extension set 28 provides slack only, and gravity is primarily responsible for the folding action of the distal gate arm 16, an object will not be forcibly pinched between the first segment 12 and the second segment 16 if it is located between the two arms when the gate arm 10 translates between the fully extended closed position and the fully folded open position. The outer offset bracket 20, the links 22, 24 and 26, and the extension set 28 are all pivotally affixed to each other using pivot pins 41. The hinge 18 may be comprised of two hinge plates 42 and 44, shown in FIG. 10, pivotally connected by a pivot pin 40 and sandwiched between blocks 43 and 45, respectively, to form adapters 47 and 49 that are slid inside the segments 12 and 16, respectively. Bolts, screws, rivets, brackets or other devices may be used to affix the hinge plates 42 and 44 to the proximal gate arm 12 and distal gate arm 16. Adapters 47 and 49 are configured to provide secure attachment of the pivot hinge 18 to the first and second segments 12 and 16, and are formed from the hinge plates 42 and 44 and the blocks 43 and 45, respectively. In this embodiment, the first and second gate arm segments 12 and 16 each have a cross-sectional shape that is approximately square with rounded corners. Therefore, the adapters 47 and 49 also have a cross-sectional shape that is approximately square with rounded corners. In this embodiment, adapters 47 and 49 are configured to slide inside the first and second gate arm segments, respectively. Optionally, adapters may slide over, not inside, a portion of the gate arm segments, or may be configured to be attached to one side of the segments.

Figure 11:
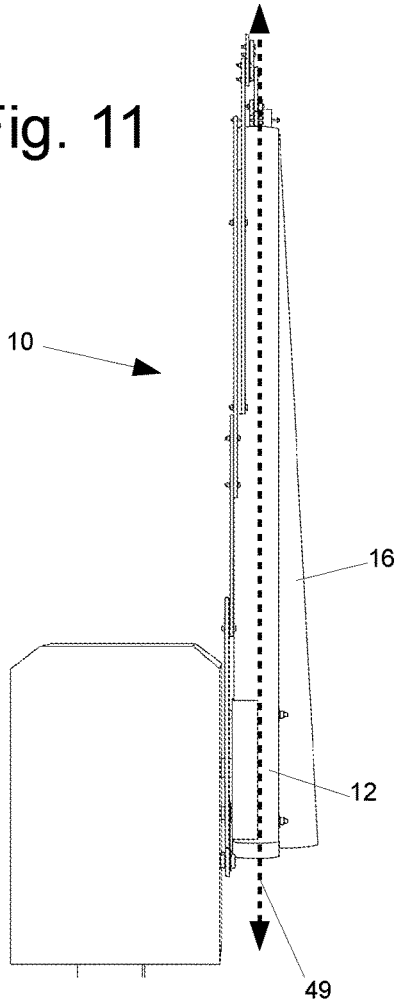
FIG. 11 is a side view of a vertically folding barrier gate arm in accordance with principles of the invention.

Vertically folding gate arms may experience wobbling in certain environments. For example, if a vertically folding gate arm is used in an area experiencing high wind, the second segment 16 may deviate from alignment within the vertical plane of rotation 49 of the first segment 12, as shown in FIG. 11. In other words the second segment wobbles. To reduce the amount of power required to raise and lower a barrier gate arm, gate arm segments are often formed from lightweight materials and are substantially hollow. While this reduces the amount of force necessary to actuate a barrier gate arm, it also makes the segments more susceptible to wobbling. This wobbling can result in stress to the hinges and other components of the gate arm, and is therefore undesirable. The embodiment shown in FIGS. 15, 20, 21 includes mechanisms for the prevention of wobbling when the gate arm is in the upright position and to align the two segments within a vertical plane.

Figure 13:
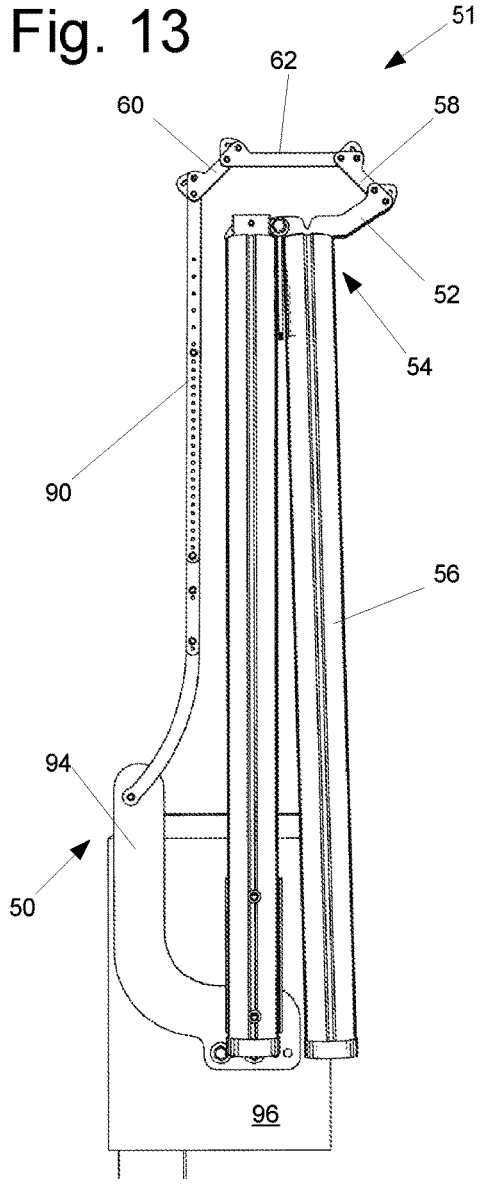
FIG. 13 is a front view of an alternative embodiment of a vertically folding barrier gate arm in the open position in accordance with principles of the invention.
Figure 12:
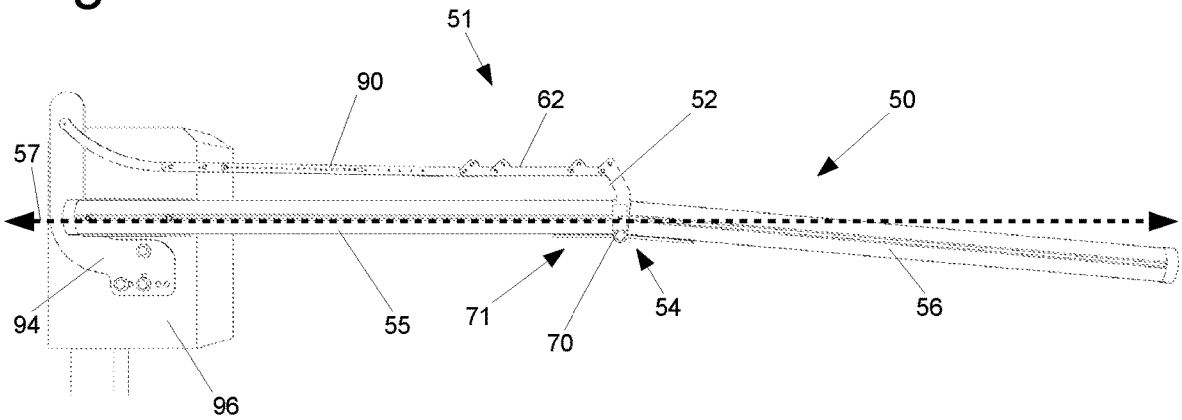
FIG. 12 is a front view of an alternative embodiment of a vertically folding barrier gate arm in the closed position in accordance with principles of the invention.

FIG. 12 shows an alternative embodiment of a vertically folding gate arm 50 having a compound hinge 51 in a horizontal, closed position in accordance with principles of the invention. In the closed position, both the first segment 55 and the second segment 56 lies in a longitudinal axis 57 in a horizontal configuration extending away from each other from the pivot hinge 70. FIG. 13 shows the vertically folding gate arm 50 in the vertical upright open position. In this embodiment, the outer offset bracket 52 extends at an angle from the proximal end 54 of the second segment 56 at an approximately 45° angle in a proximal direction. The first link 58, unlike the first link 22 of the first embodiment, has a length approximately equal to the length of the third link 60. The first link 58 forms a 45° angle with the outer offset bracket 52 when the gate arm 50 is in the closed, extended position, and forms a 90° angle with the outer offset bracket 52 when the gate arm 50 is in the open, vertical position. Second and third links 60 and 62 are substantially the same as second and third links 24 and 26 of the previous embodiment. In FIG. 12, it can be seen that the first segment 55 and second segment 56 have not aligned exactly along the longitudinal axis 57. The second segment 56 troops to some extent. This is not unusual in a gate arm that has been in operation for some time. As explained in more detail below, this drooping can be corrected by adjusting the extension set 90. However, while the first and second segments of a gate arm are typically described herein as being: linear and/or along a longitudinal axis when in the closed position, it should be noted that this is an approximation. Such drooping or other nonadherence to a perfectly straight configuration is considered within the scope of the description of the two gate arm segments as being fully extended along a longitudinal axis and/or co-linear.

Figure 14:
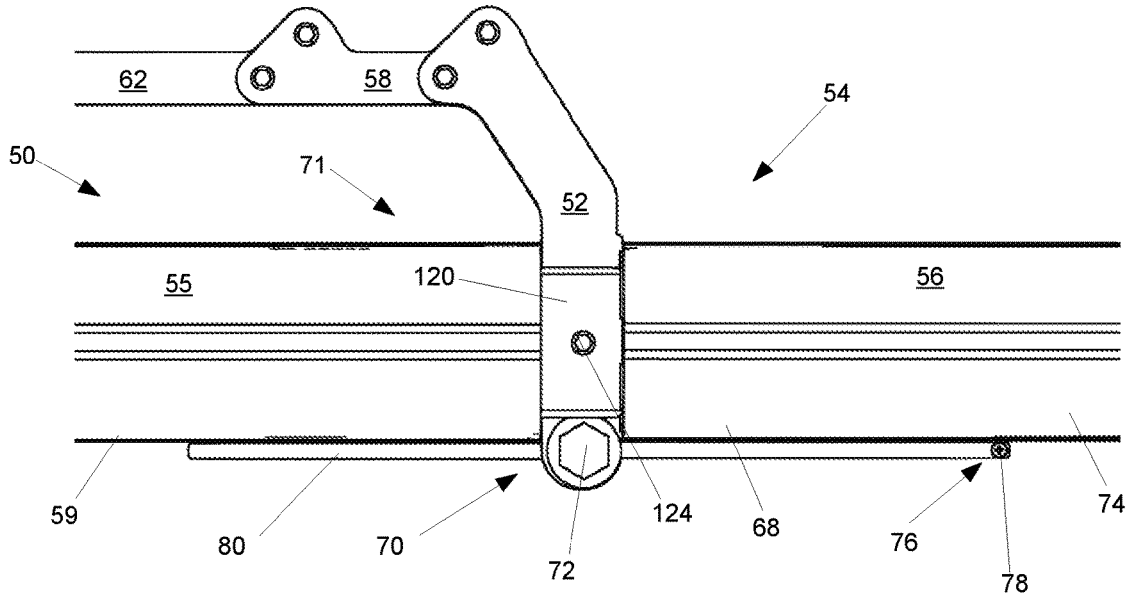
FIG. 14 is an enlarged front view of a pivot hinge of an alternative embodiment of a vertically folding barrier gate arm in the closed position in accordance with principles of the invention.
Figure 15:
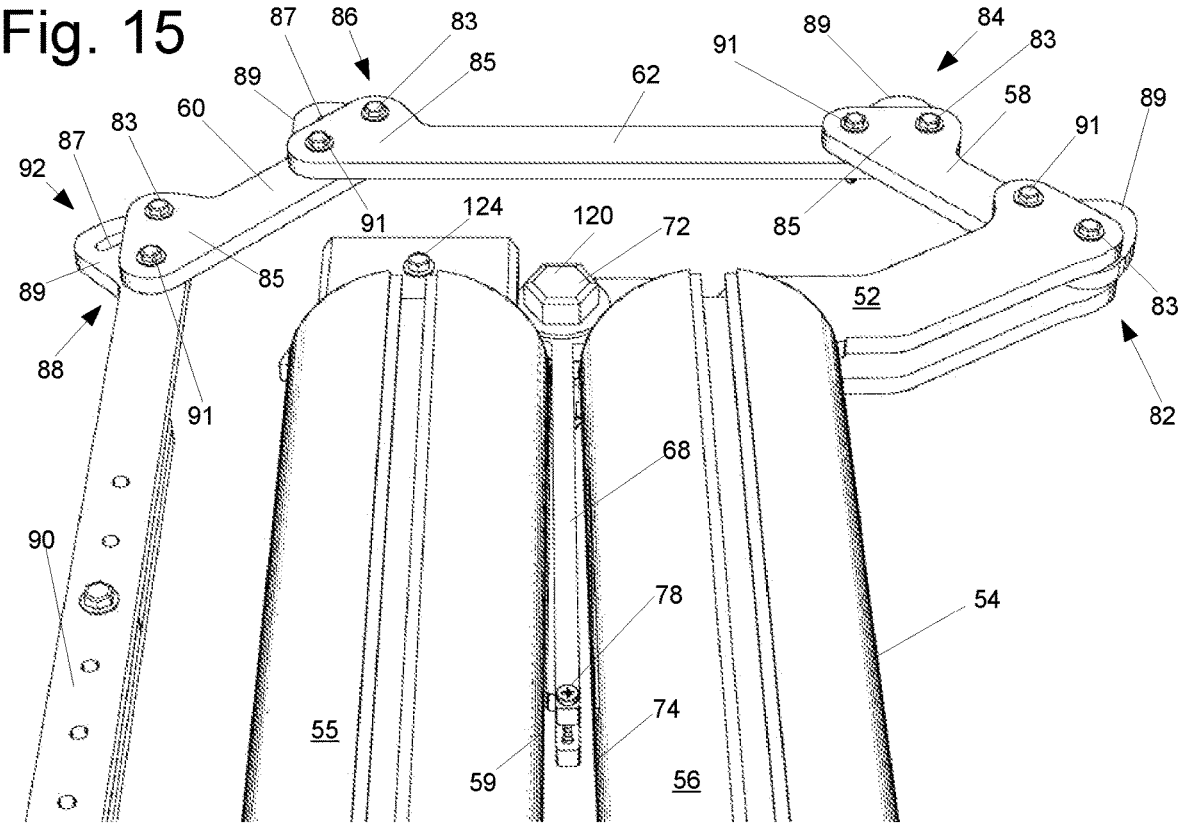
FIG. 15 is an enlarged front view of the pivot hinge of an alternative embodiment of a vertically folding barrier gate arm in the open position in accordance with principles of the invention.
Figure 16:
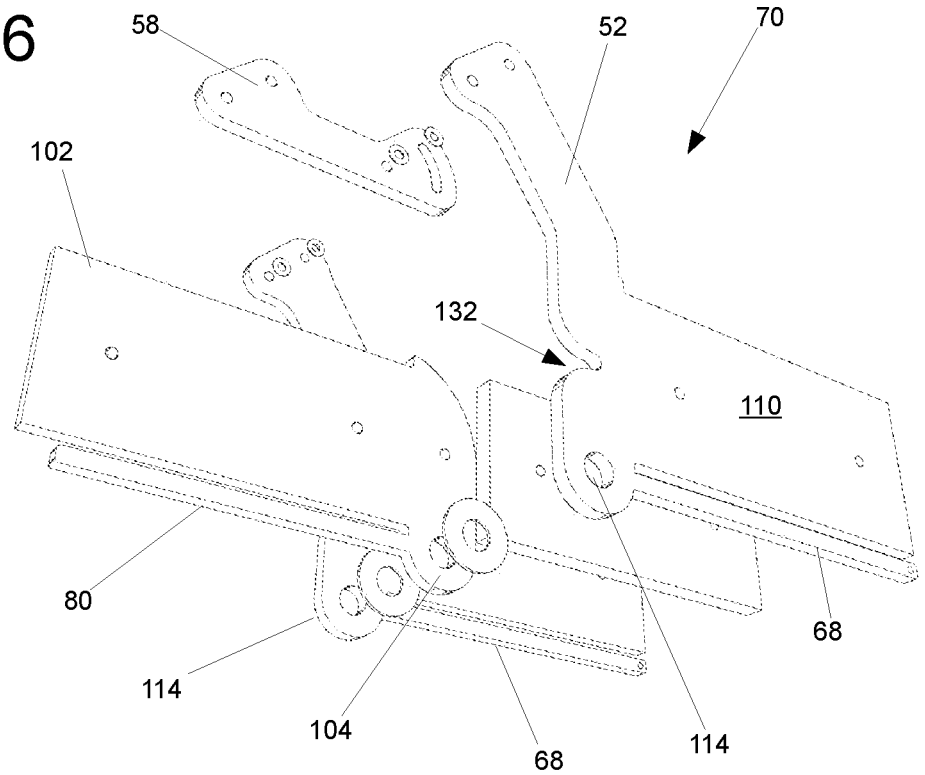
FIG. 16 is an exploded view of components of a pivot hinge of an alternative embodiment of a vertically folding barrier gate arm in accordance with principles of the invention.
Figure 17:
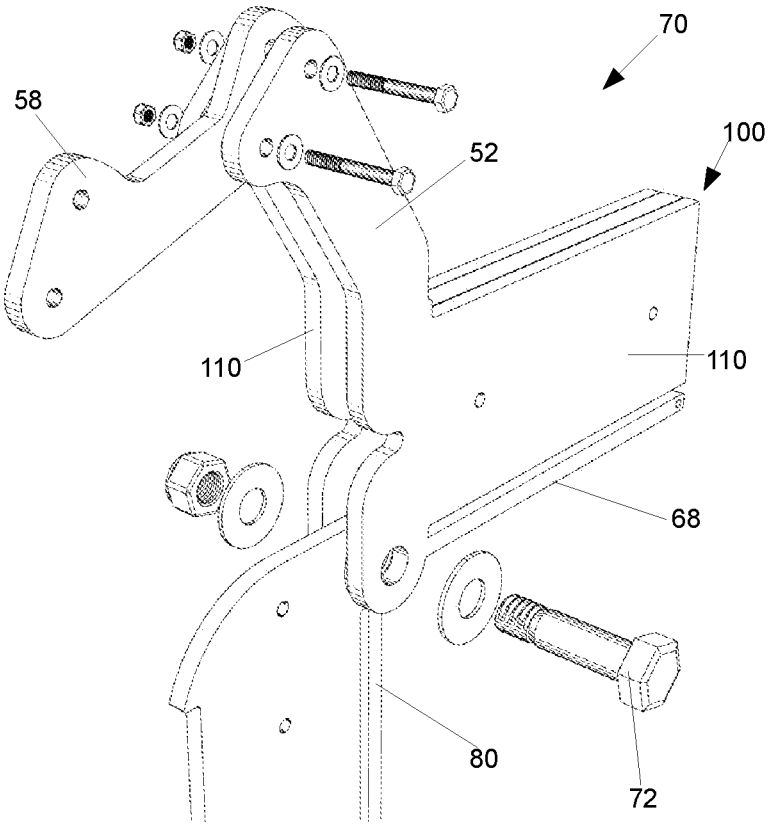
FIG. 17 is a perspective view of components of a pivot hinge of an alternative embodiment of a vertically folding barrier gate arm in accordance with principles of the invention.
Figure 18:
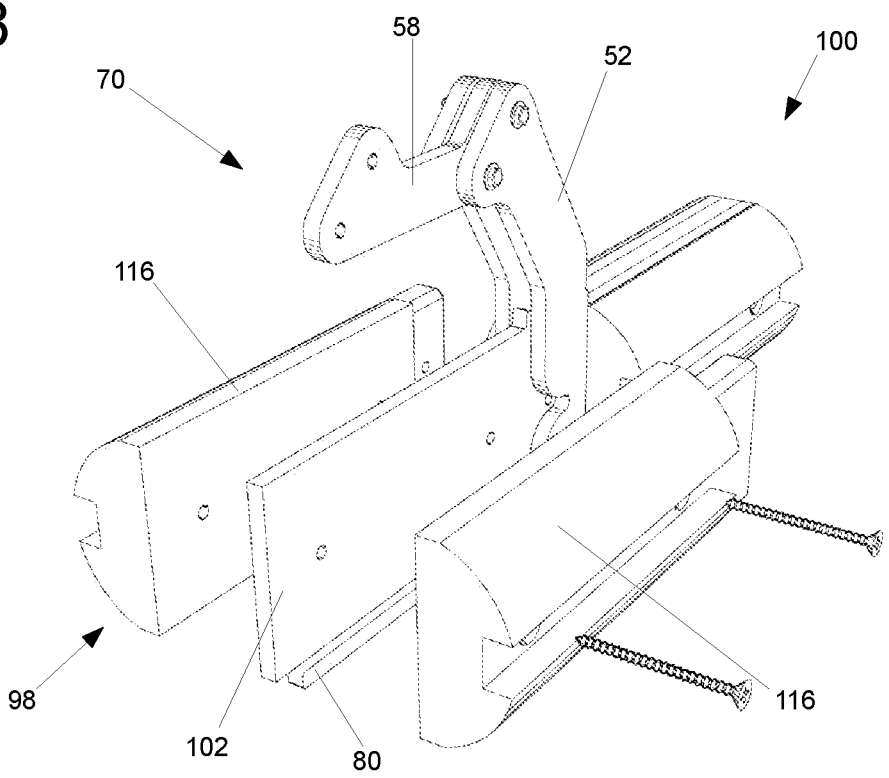
FIG. 18 is another perspective view of components of a pivot hinge of an alternative embodiment of a vertically folding barrier gate arm in accordance with the principles of the invention.
Figure 19:
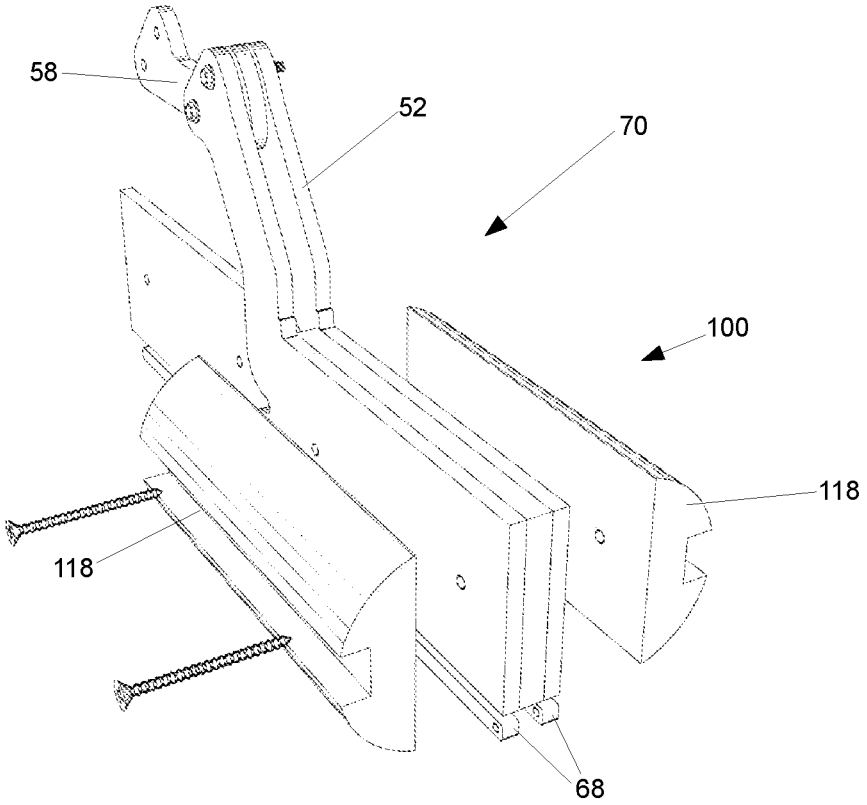
FIG. 19 is another perspective view of components of a pivot hinge of an alternative embodiment of a vertically folding barrier gate arm in accordance with principles of the invention.

FIGS. 14 and 15 show enlarged views of the region of the gate arm 50 around the pivot hinge 70. A pivot pin 72 provides rotation of the second segment 56 relative to the first segment 55. Two outer alignment rods 68 extend longitudinally in a distal direction away from the pivot hinge 70 and lay flush against the bottom 74 of the second segment 56. The distal ends 76 of the two outer alignment rods 68 are connected by a screw or bolt 78 which may be tightened or loosened to adjust the distance between the two alignment rods 68. A central alignment rod 80 extends longitudinally in a proximal direction from the pivot hinge 70 and lays flush against the bottom 59 of the first segment 55. Both the outer alignment rods 68 and the central alignment rod 80 are co-linear with the pivot pin 72, and are co-linear with each other when the gate arm 50 is in the closed horizontal position. When the folding gate arm 50 is raised into the vertical open position, the inner alignment rod 80 is positioned between the outer alignment rods 68. This action reduces wobbling of the first segment 55 and the second segment 56 relative to each other.

The hinges making up the compound hinge 51 of this embodiment are configured in essentially the same way as the compound hinge 11 of the previous embodiment. Each of the first, second, third and fourth hinges 82, 84, 86 and 92, connecting the outer offset bracket 52, first link 58, second link 62, third link 60 and extension set 90, respectively, are each constrained by a bolt 83 on the male plate 85 of the hinge that moves through a curved slot 87 on the female plate 89 of the hinge and rotate about a pivot pin 91. Each of the hinges forming the compound hinge 11 thus has a similar configuration, but may have different ranges of rotation depending on the length of the slots 37. Optionally, the bolts 33 and/or pivot pins 91 may be tightened sufficiently to prevent unintentional rotation, but not so tight as to impair mechanical articulation. The curved slot of each hinge 23, 25, 27 and 29 constraining the rotational range of the hinge and can be any size so long as the total sum of constraints provides up to 180° rotation of the outer arm.

In this embodiment, the first and second segments 55 and 56 are substantially the same length. Optionally, the first and second segments may have different lengths. If the segments have different lengths, it is generally preferable for the second segment 56 to have a length that is less than the length of the first segment 55. The first link 58 is connected to the outer offset bracket 52 by a first hinge 82 that permits free rotation of the first link 58 between 45° and 90° relative to the outer offset bracket 52. The second link 62 is connected to the first link 58 by a second hinge 84 that permits free rotation of the second link 62 between 180° and 135° relative to the first link 58. The third link 60 is connected to the second link 62 by a third hinge 86 that permits free rotation of the third link 60 between 180° and 135° relative to the second link 62. The distal end 88 of the extension set 90 is connected to the third link 60 by a fourth hinge 92 that permits free rotation from 180° and 135° of the third link 60 relative to the extension set 90. The extension set 90 is rotatably attached to an offset plate 94 on the motor housing 96. When the gate arm 50 is in the horizontal closed position, the guide 90 extends longitudinally above the first segment 55. When the gate arm 50 is in the upright vertical open position, the guide 90 extends vertically.

FIGS. 16-24 show the components of the first and second adapters 98 and 100 used to connect the pivot hinge 70 to the first and second segments 55 and 56 of vertically folding gate arm 50 and to provide a mechanism to stabilize the gate arm 50 and reduce or eliminate wobbling of the second segment 56. The first adapter 98 has a central hinge plate 102 sized to be slidably inserted into the distal end 71 of the first segment 55. It includes an offset knuckle 104 extending from the bottom of its distal end for joining to the pivot pin 72. The elongate central alignment rod 80 extends in a proximal direction coplanar with the hinge plate 102 and co-linear with the offset knuckle 104 and spaced apart from the bottom of the hinge plate 102 by a distance greater than the width of the outer wall of the first segment 55.

The second adapter 100 has two vertical hinge plates 110 separated by a central spacing plate 112 having a width equal to the width of the central vertical hinge plate 102 of the first adapter 98. Each of the two vertical hinge plates 110 includes an offset knuckle 114 extending from the bottom of its distal end for joining to the pivot pin 72. During construction of the pivot hinge 70, the knuckle 104 of the first adapter is positioned between and aligned with the knuckles 114 and the pivot pin 72 is inserted through the knuckles.

Each of the elongate outer alignment rods 68 extend in a distal direction coplanar with its respective hinge plate 110 and co-linear with its respective offset knuckle 104. The outer alignment rods 68 are spaced apart from the bottom of their respective hinge plates 110 by a distance greater than the width of the outer wall of the first segment 55.

Figure 20:
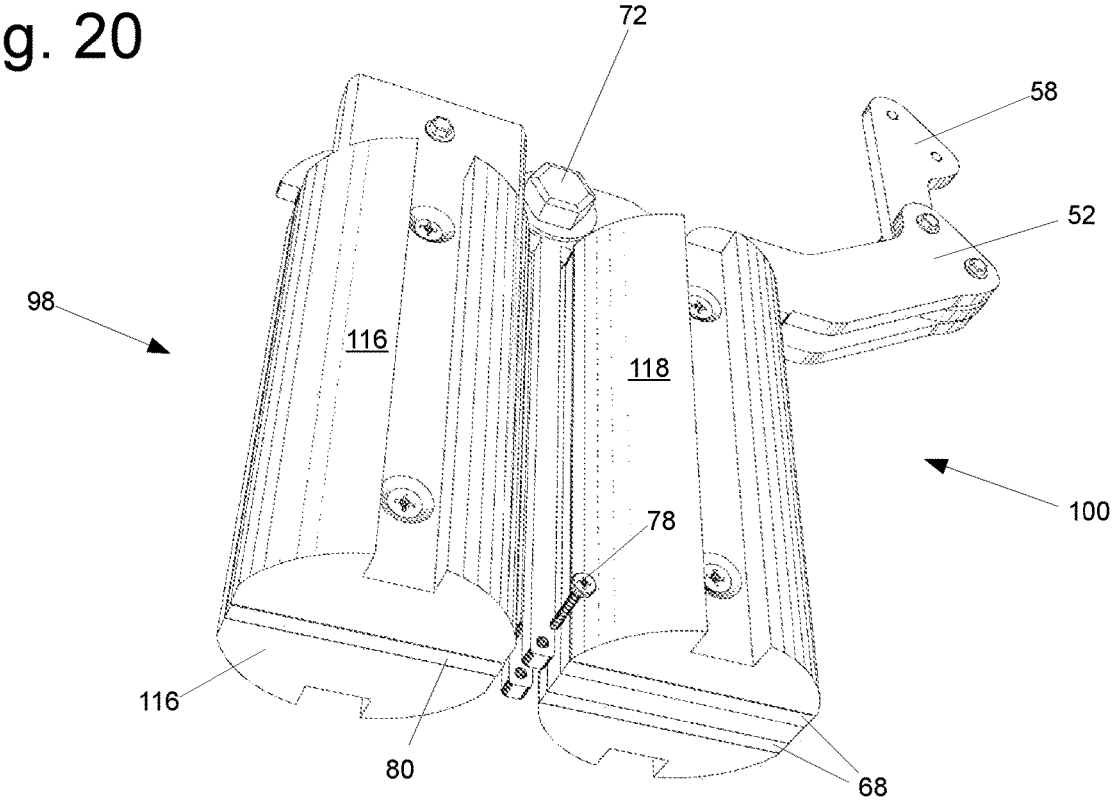
FIG. 20 is another perspective view of components of a pivot hinge of an alternative embodiment of a vertically folding barrier gate arm in accordance with principles of the invention.
Figure 21:
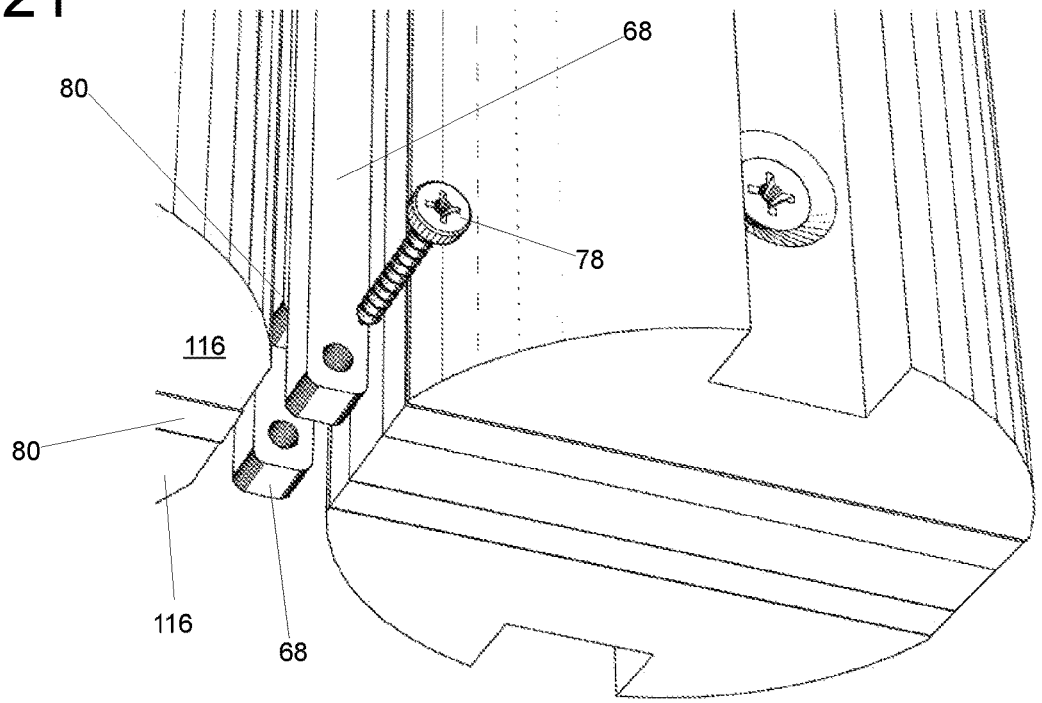
FIG. 21 is another perspective view of components of a pivot hinge of an alternative embodiment of a vertically folding barrier gate arm in accordance with principles of the invention.

The first adapter 98 also includes two blocks 116 attached to either side of the central hinge plate 102. The blocks 116 are configured to lie flush against the inside wall of the first segment 55 of the gate arm 50. In this embodiment, the two blocks 116 include curved outer surfaces to conform to a cylindrical gate arm segment. Similarly, blocks 118 attached each of the hinge plates 110 of the second adapter 100, and have curved surfaces to conform to a cylindrical gate arm segment. FIGS. 20 and 21 show the first and second adapters 98 and 100 in the closed position. For clarity, the gate arm segments 55 and 56 are removed.

Figure 22:
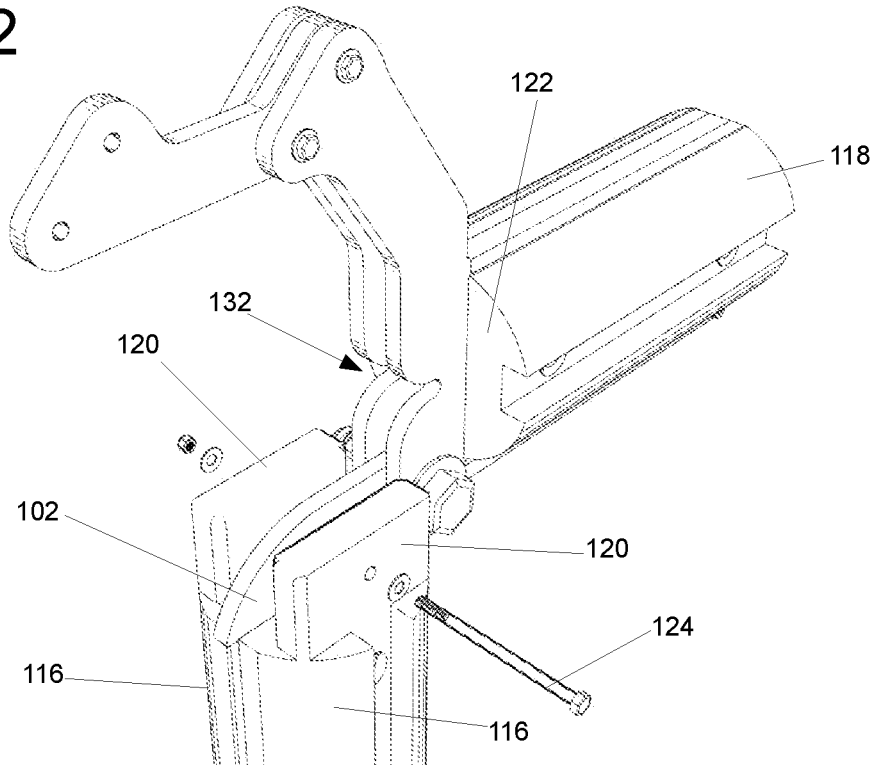
FIG. 22 is another perspective view of components of a pivot hinge of an alternative embodiment of a vertically folding barrier gate arm in accordance with the principles of the invention.
Figure 23:
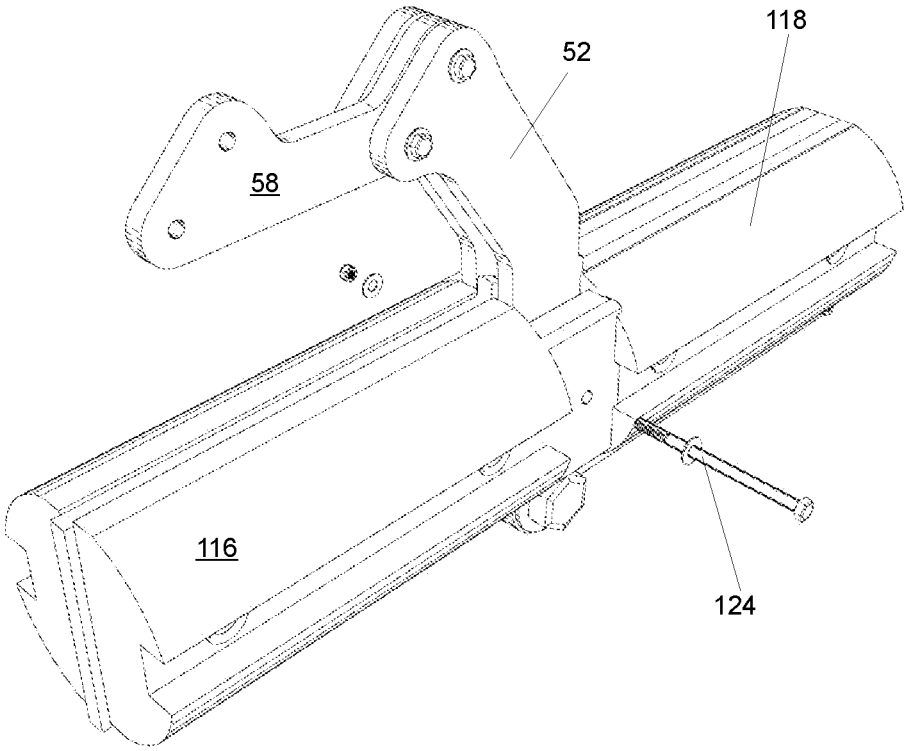
FIG. 23 is another perspective view of components of a pivot hinge of an alternative embodiment of a vertically folding barrier gate arm in accordance with the principles of the invention.
Figure 24:
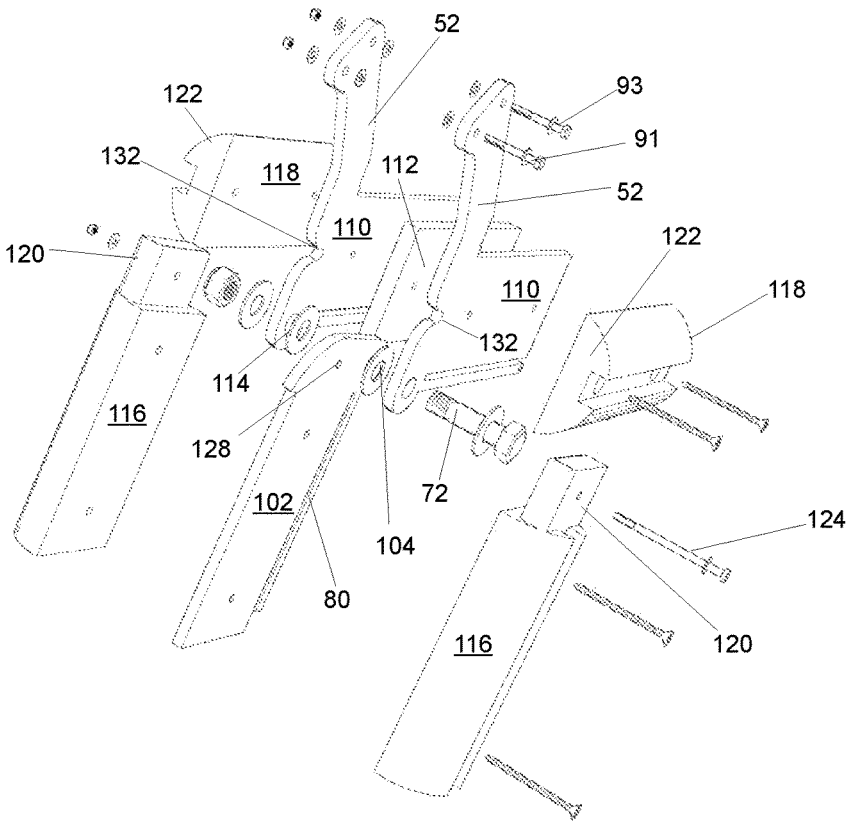
FIG. 24 is an exploded view of components of a pivot hinge an alternative embodiment of a vertically folding barrier gate arm in accordance with principles of the invention.

Referring to FIG. 22-24, blocks 116 each include an extension 120 configured to abut opposing proximal walls 122 of the blocks 118 of the second adapter 100 when the gate arm is in the extended position and the pivot hinge 70 is rotated 180°. This prevents horizontal wobbling of the second gate arm segment 56 when the gate arm 50 is in the horizontal closed position. The hinge plates 110 of the second adapter 100 slide into the spaces between the blocks 116 and the central hinge plate 102 when the gate arm 50 is in the horizontal closed position. A bolt 124 extends through the extensions 120 and through hole 128 of the central hinge plate 102. The bolt 124 may be adjusted to increase or decrease the friction fit of the hinge plates 110 when they are positioned between the extensions 120 and the central hinge plate 102 of the first adapter 98. The vertical hinge plates 110 of the second adapter 100 each include a notch 132 through which the bolt 124 extends when the gate arm 50 is in the closed horizontal position.

Figure 25:
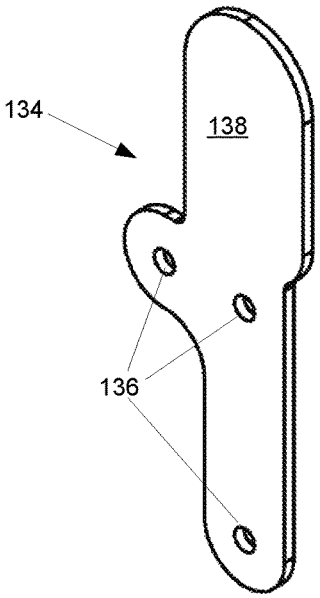
FIG. 25 is an alternative embodiment of an offset plate for a vertically folding barrier gate arm in accordance with principles of the invention.

FIG. 25 shows an alternative embodiment of an offset plate 134. The offset plate 134 includes a plurality of holes 136 that provide attachment to a motor housing. A flat panel 138 extends from the motor housing and lies within or parallel to the plane of rotation defined by the rotation of the first segment 55 between the open and closed positions. During installation, an operator selects appropriate location on the flat panel 138 through which to insert a bolt which acts as a pivot pin for an extension set. Those skilled in the art will appreciate that a wide variety of shapes may be used for offset plate. Optionally one of the sides of the motor housing which is parallel to the plane of rotation may itself be utilized as the offset plate.

Figure 26:
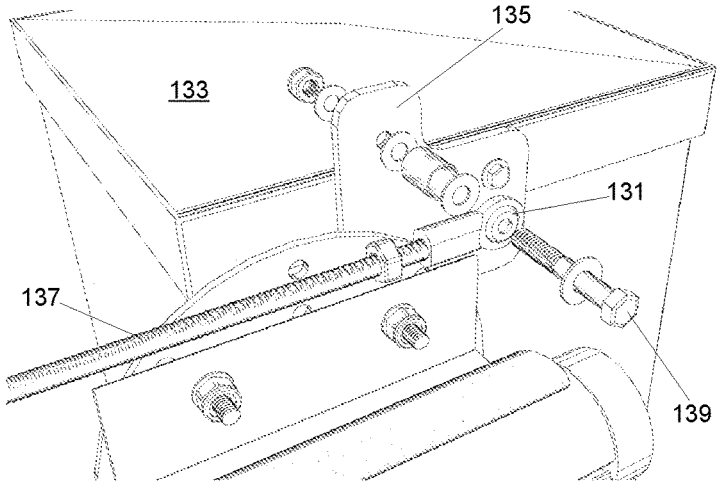
FIG. 26 is another alternative embodiment of an offset plate attached to a motor housing for a vertically folding barrier gate arm in accordance with principles of the invention.
Figure 27:
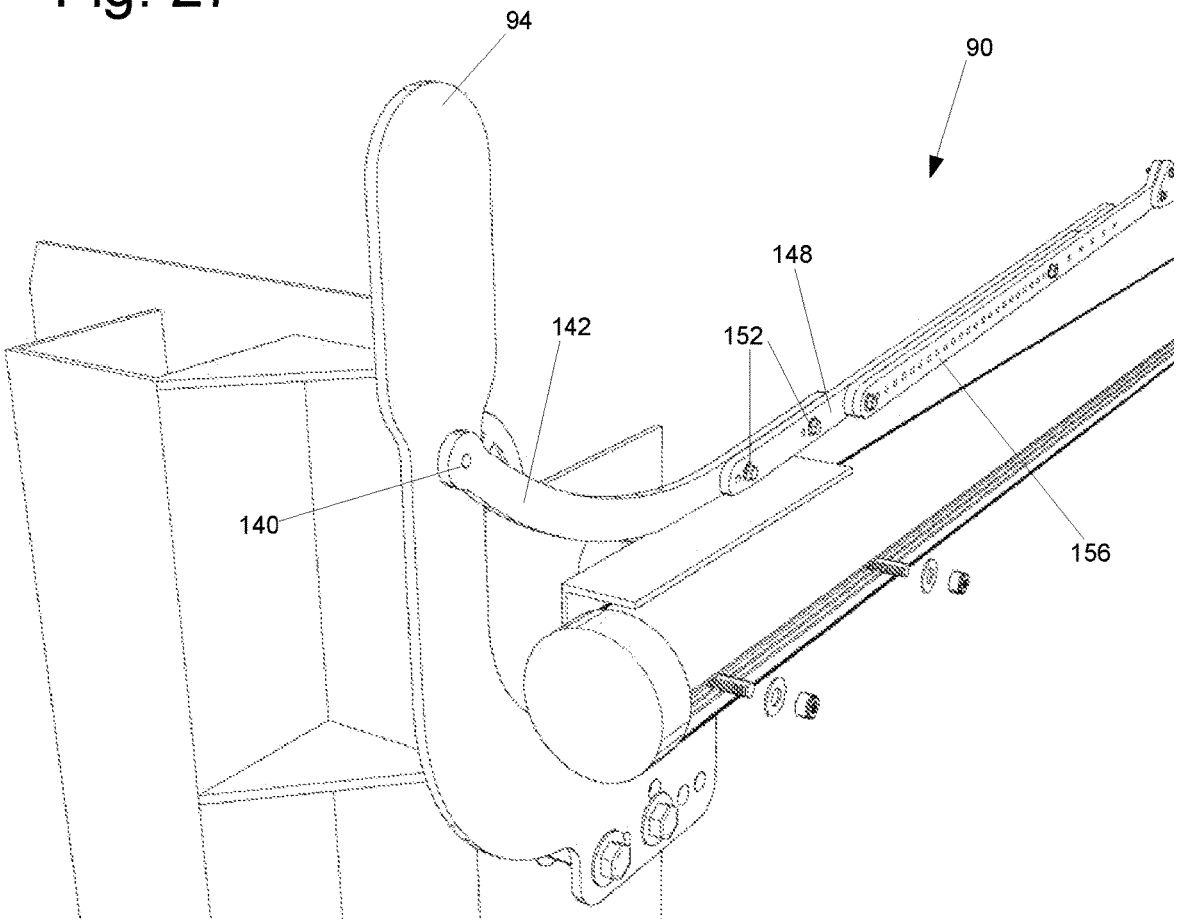
FIG. 27 is a perspective view of an alternative embodiment of a vertically folding barrier gate arm in accordance with principles of the invention.
Figure 28:
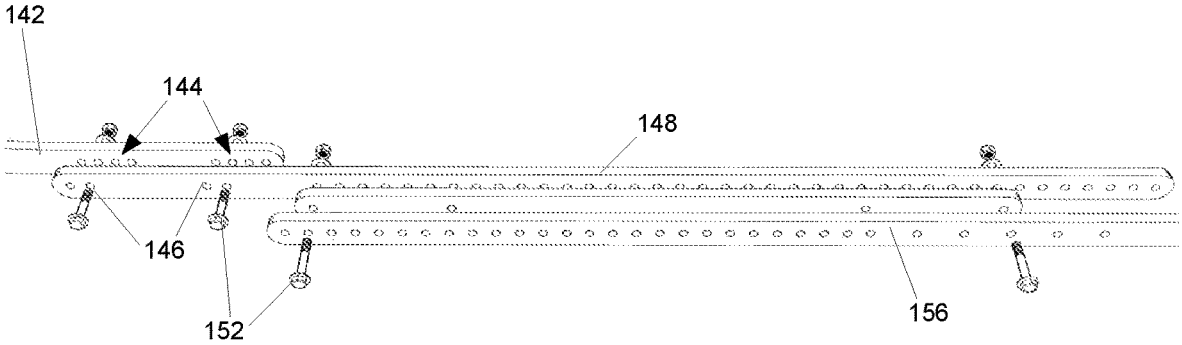
FIG. 28 is a perspective view of the components of an extension set for a vertically folding barrier gate arm in accordance with principles of the invention.
Figure 29:
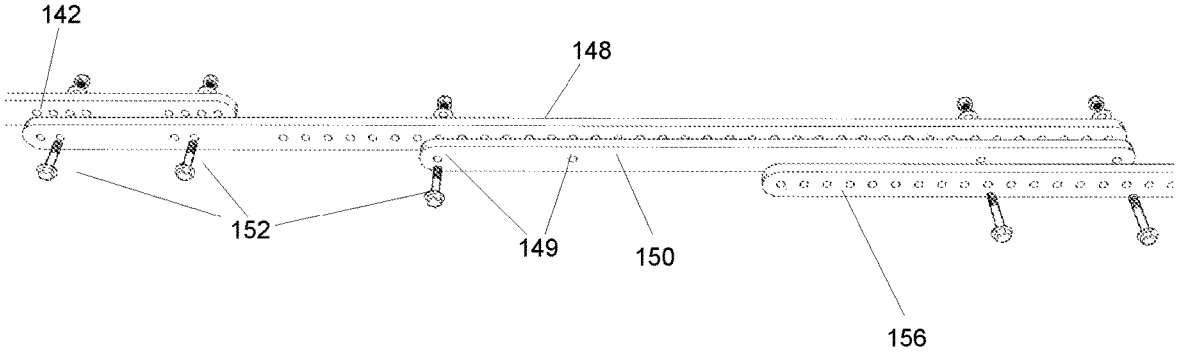
FIG. 29 is another perspective view of the components of an extension set for vertically folding barrier gate arm in accordance with principles of the invention.
Figure 30:
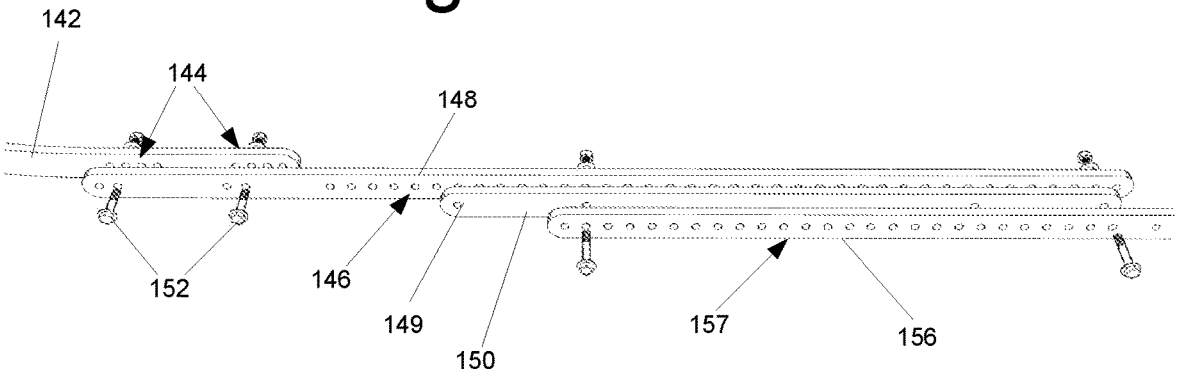
FIG. 30 is another perspective view of the components of an extension set for a vertically folding barrier gate arm in accordance with principles of the invention.

FIG. 26 shows another alternative embodiment of an offset plate 135 attached to a motor housing 133 and pivotally attached to an extension set 137. In this embodiment, the extension set 137 is a cylindrical threaded rod having an eyelet 131 that attaches to a pivot pin 139 that extends through the offset plate 135.

Referring to FIGS. 27-30, the length of extension set 90 may be adjusted by adjusting the attachment points between its components. Extension set 90 is pivotally attached to the offset plate 94 by a pivot pin 140. The extension set 90 of this embodiment is formed from four segments. Optionally, the extension set 90 may be formed from a single component or from more than four components.

The segments of the extension set 90 can be adjusted in small increments. The installer would cut inner segment 55 and outer segment 56 to the desired length. The curved rod 142 includes drilled holes 144 that align with holes 146 in the proximal arm rod extension 148 extension and/or the holes 149 intermediary arm rod extension 150. The proximal arm rod extension 148 and/or the intermediary arm rod extension 150 are connected to the distal arm rod extension 156 by bolts 152 extending through holes 157 to form a complete extension set 90. The installer will leave the curved rod 142 connected to the Offset Plate 94. Installer will place the extension set 90 in a horizontal position and lift the outer segment gently to push pressure on it. Installer then inserts bolts 152 through the holes 146 in the proximal arm rod extension 148 and/or the holes 149 of the intermediary arm rod extension 150 wherever they align perfectly. By removing all slack, the arm will remain in a fully-horizontal position when closed. The holes 144 of curved rods 142, holes 146 of proximal rod extension 148, holes 149 of the intermediary arm rod extension 150, and the holes 157 of the distal arm rod extension 156 may be spaced by the same or differing increments. For example, holes 146 may be spaced at 1/16 inch increments while holes 149 are spaced at 3/32 inch increments. As a result, when one of holes 146 is aligned with one of holes 149, some but not all of the remaining holes 146 in 149 will align with each other. By spacing holes on each rod by different incremental amounts, a variety of patterns of aligned holes on different extension rods will arise.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A vertically folding barrier gate arm operative to selectively block a roadway comprising:

a motor housing having a rotating bracket;

an elongate first segment of the barrier gate arm having a proximal end attached to the rotating bracket of the motor housing, the rotating bracket providing 90° rotation of the first segment between a closed horizontal position and an open vertical position;

an elongate second segment of the barrier gate arm having a proximal end and a distal end;

a pivot hinge connecting a distal end of the first segment to a proximal end of the second segment and providing rotation of the second segment from about 0° up to about 180° relative to the first segment when the first segment is rotated from the closed horizontal position to the open vertical position;

an offset plate affixed to the motor housing;

an extension set having a proximal end pivotally attached to the offset plate and extending in a distal direction above the rotating bracket;

a compound multi-articulated hinge located above the pivot hinge and connecting the extension set to an outer offset bracket at the proximal end of the second segment;

wherein the second segment extends horizontally and forms a 180° angle with the first segment when the first segment is in the closed horizontal position, and the second segment extends vertically downward and forms an angle of as at least 0° with the first segment when the first segment is in the open vertical position.

2. The vertically folding barrier gate arm of claim 1 wherein the compound hinge comprises:

a first link having a distal end rotatably connected to an offset arm extending upward from proximal end of the second segment by a first hinge, wherein the first hinge provides free rotation of the first link between orientations parallel to and 45° relative to the second segment;

a second link having a distal end rotatably connected to a proximal end of the first link by a second hinge, wherein the second hinge provides free rotation of the second link between orientations parallel to and 45° relative to the first link;

a third link having a distal end rotatably connected to a proximal end of the second link by a third hinge, wherein the third hinge provides free rotation of the third link between orientations parallel to and 45° relative to the second link;

wherein a distal end of a guide rod is rotatably connected to the third link by a fourth hinge, wherein the fourth hinge provides free rotation of the third link between orientations parallel to and 45° relative to the third link; and, wherein the first link, second link, third link and the guide rod are all parallel to each other when the first segment is in the closed horizontal position, and the first, second, third and fourth hinges of the compound hinge are all rotated 45° such that the compound hinge rotates the second segment to between 5° and 10° relative to the first segment.

3. The vertically folding barrier gate arm of claim 2 wherein a pivot pin is attached to a primary anchor configured to slide inside the first segment and a secondary anchor configured to slide inside the second segment.

4. The vertically folding barrier gate arm of claim 3 wherein the primary anchor further comprises a primary alignment rod extending along a bottom side of the first segment.

5. The vertically folding barrier gate arm of claim 4 wherein the secondary anchor further comprises two secondary alignment rods extending parallel along a bottom of the second segment and connected to each at their distal ends.

6. The vertically folding barrier gate arm of claim 5 wherein the primary alignment rod is located between the two secondary alignment rods when the first segment is in the open vertical position.

7. The vertically folding barrier gate arm of claim 6 wherein the second link has a length equal to twice a width of the first segment.

8. The vertically folding barrier gate arm of claim 7 wherein the offset arm at the proximal end of the second segment extends at an angle 45° relative to the second segment.

9. The vertically folding barrier gate arm of claim 7 wherein the offset arm at the proximal end of the second segment extends perpendicularly relative to the second segment.

10. The vertically folding barrier gate arm of claim 1 wherein the guide rod is a rigid rod having an adjustable length.

11. The vertically folding barrier gate arm of claim 10 wherein the guide rod comprises two rigid sections and the length of the guide rod is adjusted by adjusting the position of the two rigid sections relative to each other and securing the two rigid sections to each other using bolts.

12. The vertically folding barrier gate arm of claim 11 wherein a proximal end of the guide rod curves away from the first segment.

* * * * *